US005187143A

United States Patent [19]

Watanabe et al.

[11] Patent Number: 5,187,143

[45] Date of Patent: Feb. 16, 1993

[54] HEAT SENSITIVE RECORDING MATERIAL

[75] Inventors: Kazuo Watanabe, Itami; Tosaku Okamoto, Osaka, both of Japan

[73] Assignee: Kanzaki Paper Manufacturing Co., Ltd., Tokyo, Japan

[21] Appl. No.: 783,021

[22] Filed: Oct. 25, 1991

[30] Foreign Application Priority Data

Oct. 25, 1990 [JP] Japan ..... 2-289301
Jun. 13, 1991 [JP] Japan ..... 3-169460

[51] Int. Cl.[5] ..... B41M 5/32

[52] U.S. Cl. ..... 503/212; 503/216; 503/217; 503/221; 503/225

[58] Field of Search ..... 427/150; 503/212, 216, 503/217, 221, 225

[56] References Cited

U.S. PATENT DOCUMENTS 3,864,146 2/1975 Oda et al. ..... 503/217
3,924,027 12/1975 Saito et al. ..... 427/150
4,236,732 12/1980 Murakami et al. ..... 428/913

FOREIGN PATENT DOCUMENTS 319283 6/1989 European Pat. Off. .

*Primary Examiner*—Pamela R. Schwartz
*Attorney, Agent, or Firm*—Armstrong, Westerman, Hattori, McLeland & Naughton

[57] ABSTRACT

The present invention provides a heat sensitive recording material having a recording layer formed on a substrate and containing a colorless or light-colored basic dye and a color developer, the heat sensitive recording material being characterized in that the color developer includes a zinc salt of terephthalaldehydic acid or a composite zinc salt of terephthalaldehydic acid and other aromatic carboxylic acid.

11 Claims, No Drawings

HEAT SENSITIVE RECORDING MATERIAL

The present invention relates to heat sensitive recording materials, and more particularly to heat sensitive recording materials which are diminished in background fog and excellent in the preservability of recorded images, especially in resistance to oils, plasticizers and solvents and which have a high recording sensitivity.

Heat sensitive recording materials are already known which contain a colorless or light-colored basic dye and a color developer for producing a color with use of the heat energy of a thermal head or the like. Such heat sensitive recording materials are relatively inexpensive, are adapted for use with recording devices which are compact and relatively easy to maintain and have therefore found wide use as recording media for facsimile systems and various computers and also as heat sensitive labels and the like.

In recent years, thermal facsimile systems are operable at a recording speed of up to 10 seconds for A4 size paper and thermal printers at not lower than 120 characters/second, and a higher sensitivity is required of heat sensitive recording materials more than ever. Further with wider use of the POS (Point of sales) system contemplated for savings in labor in retail business, heat sensitive recording labels are in growing use.

However, usual heat sensitive recording materials wherein bisphenol A or like phenolic color developer is used have the drawback of producing record images of greatly reduced density or permitting unnecessary formation of color, i.e., so-called background fogging, for example, when the fat of human skin, a solvent or plasticizer comes into contact with the recording layer. Further, the heat sensitive recording label is usually employed as adhered to vinylidene chloride film or like wrapping film, and therefore has the drawback of rapidly lowering record density due to an influence of plasticizer contained in the wrapping film. To obviate the drawback, various proposals have been made such as provision of a protective layer over the recording layer, addition of a preservability improving agent to the recording layer and use of a new color developer. Nevertheless, such proposals are likely to entail another drawback or not always achieve an effect as high as is satisfactory, so that further improvements are greatly required.

An object of the present invention is to provide a heat sensitive recording material which is less susceptible to background fog due to the influence of temperature, humidity, alcohol or the like, resistant to the discoloration of record images even when affected by humidity, oils, fats, solvents, plasticizers or the like and excellent in recording sensitivity.

The above and other objects of the invention will become apparent from the following description.

The present invention provides a heat sensitive recording material having a recording layer formed on a substrate and containing a colorless or light-colored basic dye and a color developer, the heat sensitive recording material being characterized in that the color developer comprises a zinc salt of terephthalaldehydic acid or a composite zinc salt of terephthalaldehydic acid and other aromatic carboxylic acid.

We have conducted research on the heat sensitive recording material and consequently found that a zinc salt of terephthalaldehydic acid or a composite zinc salt of terephthalaldehydic acid and other aromatic carboxylic acid, when used as a color developer, gives the recording material not only an improved recording sensitivity but also improved preservability of recorded images. Thus, the present invention has been accomplished.

The terephthalaldehydic acid is a compound represented by the following formula.

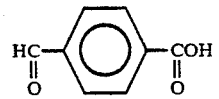

In the present invention, the zinc salt of terephthalaldehydic acid is represented by the following formula.

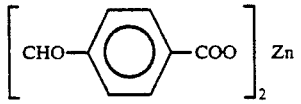

The process for preparing the zinc salt of terephthalaldehydic acid is not particularly limited. For example, the salt can be prepared by reacting sodium salt of terephthalaldehydic acid and zinc sulfate or like water-soluble zinc salt, or pulverizing terephthalaldehydic acid and zinc oxide or like zinc compound by a wet method at the same time.

In the present invention, the composite zinc salt of terephthalaldehydic acid and other aromatic carboxylic acid is preferably used, since a heat sensitive recording material can be obtained which is more excellent in the preservability of recorded images, particularly high in recording sensitivity and sufficient in record density even when recorded at low energy.

In the present invention, the composite zinc salt of terephthalaldehydic acid and other aromatic carboxylic acid is a salt in which terephthalaldehydic acid molecule bonds to other aromatic carboxylic acid molecule via zinc atom. The composite salt is different from a mere mixture of a zinc salt of terephthalaldehydic acid and a zinc salt of other aromatic carboxylic acid, and achieves the above-mentioned superior effects to the mixture.

Examples of other aromatic carboxylic acids are benzoic acid derivatives, naphthoic acid derivatives, phthalic acid derivatives, phthalamic acid derivatives, o-benzoylbenzoic acid derivatives, salicylic acid derivatives, etc. More specific examples of such acids are as follows. These examples are not limitative, while at least two aromatic carboxylic acids are usable in combination.

Benzoic acid, o-toluic acid, p-toluic acid, m-toluic acid, o-chlorobenzoic acid, p-chlorobenzoic acid, o-bromobenzoic acid, p-bromobenzoic acid, 2,4-dichlorobenzoic acid, 3,4-dichlorobenzoic acid, 3,5-dichlorobenzoic acid, 2,6-dichlorobenzoic acid, o-nitrobenzoic acid, p-nitrobenzoic acid, 2,4-dinitrobenzoic acid, 3,4-dinitrobenzoic acid, 3,5-dinitrobenzoic acid, 2,6-dinitrobenzoic acid, 2-chloro-4-nitrobenzoic acid, 2-chloro-5-nitrobenzoic acid, 4-chloro-2-nitrobenzoic acid, 4-chloro-3-nitrobenzoic acid, m-hydroxybenzoic acid, p-hydroxybenzoic acid, 2,4-hydroxybenzoic acid, 3,4-dihydroxybenzoic acid, 3,5-dihydroxybenzoic acid, gallic acid, p-cyanobenzoic acid, m-trifluoromethylbenzoic acid, 2,4-dimethylbenzoic acid, 3,4-dimethylbenzoic acid, 3,5-dimethylbenzoic acid, o-ethoxybenzoic acid, p-ethoxybenzoic acid, 3,5-dimthoxybenzoic acid, p-n-propoxybenzoic acid, 3,4,5-trimethoxybenzoic acid, p-phenoxybenzoic acid, o-phenylbenzoic acid, p-phenylbenzoic acid, o-cumylbenzoic acid, p-cumylbenzoic acid, 2,4-dicumylbenzoic acid, 4,6-dicumylbenzoic acid, p-acetylbenzoic acid, 2-cyclohexylbenzoic acid, 4-(2-phenoxyethoxy)benzoic acid, 2-ethoxymethyl-4-(p-chlorophenoxy)benzoic acid, 2-benzylbenzoic acid, 4-(p-methylbenzyloxy)benzoic acid or like benzoic acid derivative.

1-Naphthoic acid, 2-naphthoic acid, 1-hydroxy-2-naphthoic acid, 2-hydroxy-1-naphthoic acid, 2-hydroxy-3-naphthoic acid or like naphthoic acid derivative.

Phthalic acid, isophthalic acid, terephthalic acid, 3-nitrophthalic acid, 4-nitrophthalic acid, 4-chlorophthalic acid, 4-bromophthalic acid, 4,5-dichlorophthalic acid, 3,6-dichlorophthalic acid, tetrachlorophthalic acid, tetrabromphthalic acid, 3,6-dibromo-4,5-dichlorophthalic acid or like phthalic acid derivative.

Monomethylester, monoethylester, monopropylester, monobutylester, monostearylester, monobenzylester, mono-p-chlorobenzylester, mono-p-methylphenylester, mono-2,4-dimethylphenylester, mono-p-chlorophenylester, mono-m-methoxyphenylester, mono-p-methoxylphenylester, mono-m-ethoxyphenylester, mono-p-ethoxyphenylester, mono-1-naphthylester, mono-2-naphthylester, monocyclohexylester, mono-2-methylcyclohexylester, mono-3-methylcyclohexylester, mono-2-hydroxyethylester, mono-2-hydroxybutylester, mono-2-hydroxy-1-methylpropylester, mono-4-hydroxybutylester, mono-2,3-dihydroxypropylester, mono-2-(2-hydroxyethoxy)ethylester, mono-p-methylbenzylester of above-mentioned phthalic acids or like phthalic acid monoester derivative.

Phthalamic acid, 3-chlorophthalamic acid, 4-chlorophthalamic acid, 4-bromophthalamic acid, 4,5-dichlorophthalamic acid, 3,6-dichlorophthalamic acid, tetrachlorophthalamic acid, tetrabromophthalamic acid, 3,6-dibromo-4,5-dichlorophthalamic acid or like phthalamic acid derivative, and N-substituted derivatives of these phthalamic acid derivatives such as N-methyl, N-ethyl, N-butyl, N-cyclohexyl, N-benzyl, N-p-chlorobenzyl, N-p-methylbenzyl, N-phenyl, N-1-naphthyl, N-2-naphthyl, N,N-diethyl, N-methyl-N-benzyl, N,N-pentamethylene derivative or like phthalamic acid derivative.

2-Benzoylbenzoic acid, 2-(4'-methylbenzoyl)benzoic acid, 2-(2'-hydroxy-5'-methylbenzoyl)benzoic acid, 2-(4'-hydroxybenzoyl)benzoic acid, 2-(2'-hydroxybenzoyl)benzoic acid, 2-(3'methyl-4'-hydroxybenzoyl)benzoic acid, 2-(2'-hydroxy-5'-tert-butylbenzoyl)benzoic acid, 2-(2'-hydroxy-5'-tert-octylbenzoyl)benzoic acid, 2-(2'-hydroxy-5'-cyclohexylbenzoyl)benzoic acid, 2-(2',4'-dihydroxybenzoyl)benzoic acid, 2-(2'-hydroxy-5'-phenylbenzoyl)benzoic acid, 2-(4'-cyclohexylbenzoyl)benzoic acid, 2-(4'-phenylbenzoyl)benzoic acid, 2-(4'-chlorobenzoyl)benzoic acid, 2-(2',4'-dichlorobenzoyl)benzoic acid, 2-(2'-hydroxy-5'-chlorobenzoyl)benzoic acid, 2-(3'-methyl-4'-hydroxybenzoyl)benzoic acid, 2-(4'-bromobenzoyl)benzoic acid or like ortho benzoylbenzoic acid derivative.

5-tert-Octylsalicylic acid, 3,5-di-tert-butylsalicylic acid, 3-chloro-5-cumylsalicylic acid, 3-methyl-5-tert-octylsalicylic acid, 3-methyl-5-α-methylbenzylsalicylic acid, 3-methyl-5-cumylsalicylic acid, 3,5-di-tert-amylsalicylic acid, 3-phenyl-5-benzylsalicylic acid, 3-phenyl-5-tert-octylsalicylic acid, 3-phenyl-5-α-methylbenzylsalicylic acid, 3,5-di-tert-octylsalicylic acid, 3,5-di(α-methylbenzyl)salicylic acid, 3,5-dicumylsalicylic acid, 4-methyl-5-(α-methylbenzyl)salicylic acid, 4-methyl-5-cumylsalicylic acid, 3-(α-methylbenzyl)-6-methylsalicylic acid, 3-(α-methylbenzyl)-6-phenylsalicylic acid, 3-triphenylmethylsalicylic acid, 3-diphenylmethylsalicylic acid, 4-n-dodecylsalicylic acid, 4-tert-dodecylsalicylic acid, 4-n-pentadecylsalicylic acid, 4-n-heptadecylsalicylic acid, 5-(1,3-diphenylbutyl)salicylic acid, 5-n-octadecylsalicylic acid, 5-dodecylsulfonylsalicylic acid, 5-dodecylsulfosalicylic acid, 3-methyl-5-dodecylsulfosalicylic acid or like salicylic acid derivative.

Among the above aromatic carboxylic acids, preferable are benzoic acid derivative, phthalic acid derivative and ortho benzoylbenzoic acid derivative.

Particularly preferable are isophthalic acid derivative, benzoic acid derivative of the following formula [I] and ortho benzoylbenzoic acid derivative of the following formula [II] and especially preferable are isophthalic acid, p-toluic acid and 2-(4'-chlorobenzoyl)benzoic acid, which afford more excellent effect.

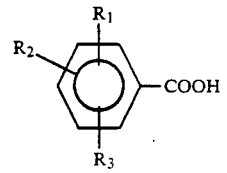

[I]

wherein $R_1$, $R_2$ and $R_3$ are each hydrogen atom, halogen atom, $C_{1\sim4}$ alkyl or $C_{1\sim4}$ alkoxyl.

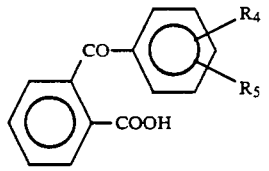

[II]

wherein $R_4$ and $R_5$ are each hydrogen atom, halogen atom or $C_{1\sim4}$ alkyl.

Although the composite zinc salt of the invention is not limited specifically with respect to the proportions of terephthalaldehydic acid and other aromatic carboxylic acid, it is desirable to use 0.5 to 2 equivalent weights, more desirably 1 equivalent weight, of the other aromatic carboxylic acid per equivalent weight of terephthalaldehydic acid. For example, the expression "to use 1 equivalent weight of the aromatic carboxylic acid per equivalent weight of terephthalaldehydic acid" means to use 1 mole of the aromatic carboxylic acid when this acid has one carboxyl group in the molecule or to use 0.5 mole the aromatic carboxylic acid when the acid has two carboxyl groups.

The composite zinc salt of terephthalaldehydic acid and other aromatic carboxylic acid can be prepared, for example, by (1) reacting an alkali metal salt of terephthalaldehydic acid, and alkali metal salt of other aromatic carboxylic acid and a zinc compound in water or a solvent mixture of water and an organic solvent, or (2) pulverizing terephthalaldehydic acid, other aromatic carboxylic acid and a zinc compound by a wet method at the same time.

The method (1) is advantageous in respect of the yield and purity of the zinc salt although slight difficulty is encountered in the preparation procedure, while the method (2) has the advantage of giving the composite zinc salt with extreme ease although somewhat disadvantageous in respect of the yield and purity of the zinc salt.

The organic solvent for use in the method (1) is preferably one having low solubility in water but capable of dissolving the resulting composite zinc salt to a high degree. Examples of such solvents are aromatic compounds, halides and ester compounds, more specifically toluene, xylene, trichlene, ethyl acetate, etc.

The zinc compound to be used for preparing the composite zinc salt can be zinc oxide, zinc hydroxide, zinc carbonate, zinc sulfate, zinc chloride or the like. For use in the method (1), zinc sulfate or zinc chloride is especially preferred, while for use in the method (2) zinc oxide is especially desirable. Although the amount of zinc compound to be used is not limited specifically, it is desired that the amount be approximately equivalent to the carboxyl group of both terephthalaldehydic acid and other aromatic carboxylic acid.

In the present invention, the composite zinc salt of terephthalaldehydic acid and other aromatic carboxylic acid may contain a small amount of a zinc salt of terephthalaldehydic acid and/or a zinc salt of other aromatic carboxylic acid as a by-product and affords the desired effects sufficiently as far as the composite salt is a main component.

In the present heat sensitive recording material, various dyes are known as the colorless or light-colored basic dye which is contained in the heat sensitive recording layer. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-dimethylaminophthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-(p-dimethylaminophenyl)-3-(1-methylpyrrole-3-yl)-6-dimethylaminophthalide, 3-(p-dibenzylaminophenyl)-3-(1,2-dimethylindole-3-yl)-7-azaphthalide, 3-(4-diethylamino-2-ethoxyphenyl)-3-(1-ethyl-2-methylindole-3-yl)-7-azaphthalide, 3,3-bis(1-ethyl-2-methylindole-3-yl)phthalide, N-butyl-3-{bis[4-(N-methylanilino)phenyl]methyl}carbazole, etc.

Diphenylmethane-based dyes, e.g., 4,4'-bis(dimethylamino)benzhydryl benzyl ether, N-halophenylleucoauramine, N-2,4,5-trichlorophenyl-leucoauramine, 4,4'-bis(dimethylamino)benzhydryl-p-toluenesulfinic acid ester, etc.

Divinylphthalide-based dyes, e.g., 3,3-bis[1,1-bis(4-pyrrolidinophenyl)ethylene-2-yl]-4,5,6,7-tetrabromophthalide, 3,3-bis[1-(4-methoxyphenyl)-1-(4-dimethylaminopheny)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Thiazine-based dyes, e.g., 3,7-bis(diethylamino)-10-benzoylphenoxazine, benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spirodinaphthopyran, 3-benzyl-spiro-dinaphthopyran, 3-methylnaphto(6'-methoxybenzo)spiropyran, 3-propyl-spirodibenzopyran, di-β-naphthospiropyran, 3-methyl-di-β-naphthospiropyran, etc.

Lactam-based dyes, e.g., rhodamine-B-anilinolactam, rhodamine(p-nitroanilino)lactam, rhodamine(o-chloroanilino)lactam, etc.

Fluoran-based dyes, e.g., 3-diethylamino-6-methylfluoran, 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-β-chloroethyl-N-methylamino)fluoran, 3-diethylamino-7-diethylaminofluoran, 4-benzylamino-8-diethylaminobenzo[a]fluoran, 3-[4-(4-dimethylaminoanilino)anilino]-7-chloro-6-methylfluoran, 8-[4-(4-dimethylaminoanilino)anilino]benzo[a]fluoran, 3-(N-ethyl-p-toluidino)-6-methyl-7-phenylaminofluoran, 3-(N-ethyl-p-toluidino)-6-methyl-7-(p-toluidino)-fluoran, 3-diethylamino-6-methyl-7-phenylaminofluoran, 3-dimethylamino-6-methyl-7-phenylaminofluoran, 3-di(n-butyl)amino-6-methyl-7-phenylaminofluoran, 3-di(n-pentyl)amino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-di(n-butyl)amino-7-(o-chlorophenylamino)fluoran, 3-(N-ethyl-N-tetrahydrofurfurylamino)-6-methyl-7-phenylaminofluoran, 3-(N-methyl-N-propylamino)-6-methyl-7-phenylaminofluoran, 3-pyrrolidino-6-methyl-7-p-butylphenylaminofluoran, 3-(N-ethyl-N-isobutylamino)-6-methyl-7-phenylaminofluoran, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, 3-[N-(3-ethoxypropyl)-N-methylamino]-6-methyl-7-phenylaminofluoran, 3-[N-ethyl-N-(3-ethoxypropyl-)amino]-6-methyl-7-phenylaminofluoran, 3-diethylamino-7-[m-(trifluoromethyl)phenylamino]fluoran, 3-diethylamino-7-(o-fluorophenylamino)fluoran, 3di(n-butyl)amino-7-(o-fluorophenylamino)fluoran, 3-diethylamino-6-chloro-7-phenylaminofluoran, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6bis(dimethylamino)-spiro[fluorene-9,6'-6'H-chromeno(4,3-b)indole], 3,6-bis(dimethylamino)-3'-methyl-spiro[fluorene-9,6'-6'H-chromeno(4,3-b)-indole], 3,6-bis(diethylamino)-3'-methyl-spiro[fluorene-9,6'-6'H-chromeno(4,3-b)indole], etc. These basic dyes are not limited to thereabove and can be used, as required, in a mixture of at least two of them.

When the present specific color developer is used in a heat sensitive recording material employing 3-di(n-butyl)amino-6-methyl-7-phenylaminofluoran, a heat sensitive recording material can be obtained which is particularly excellent not only in whiteness of the recording layer but in resistance to plasticizer or like preservability of recorded images.

With the heat sensitive recording material of the present invention, the proportions of the basic dye and the zinc salt of terephthalaldehydic acid or the composite zinc salt of terephthalaldehydic acid and other aromatic carboxylic acid to be incorporated into the recording layer should be suitably determined according to the kind of basic dye and the kind of aromatic carboxylic acid forming the composite zinc salt and are not limited specifically. However, it is generally desirable to use 0.5 to 50 parts by weight, more desirably about 1 to about 10 parts by weight, of the zinc salt or the composite zinc salt per part by weight of the basic dye.

Although the present invention is characterized in that the zinc salt of terephthalaldehydic acid or the composite zinc salt of terephthalaldehydic acid and other aromatic carboxylic acid is used as a color developer, known color developers, such as those given below, can also be used conjointly with the developer insofar as the contemplated effect of the invention will not be impaired. Examples thereof are 4-tert-butylphenol, α-naphthol, β-naphthol, 4-acetylphenol, 4-tert-octylphenol, 4,4'-sec-butylidenediphenol, 4-phenylphenol, 4,4'-dihydroxydiphenylmethane, 4,4'-isopropylidenediphenol (bisphenol-A), hydroquinone, 4,4'-cyclohexylidenebisphenol, 1,4-bis[α-methyl-α-(4'-hydroxyphenyl)ethyl]benzene, 1,3-bis[α-methyl-α-(4'-hydroxyphenyl)ethyl]benzene, 4,4'-(1,3-dimethylbutylidene)bisphenol, 2,2-bis(4-hydroxyphenyl)-4-methylpentane, 1,1-bis(4-hydroxyphenyl)-1-phenylethane, 1-[α-methyl-α-(4'-hydroxyphenyl)ethyl]-4-[α',α'-bis(4''-hydroxyphenyl)ethyl]benzene, 4,4'-dihydroxydiphenylsulfide, 4,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl)sulfone, 1,3-di[2-(4-hydroxyphenyl)-2-propyl]benzene, hydroquinone monobenzyl ether, butyl bis(4-hydroxyphenyl)acetate, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, 2-phenoxyethyl bis(4-hydroxyphenyl)acetate, p-hydroxy-N-(2-phenoxyethyl)benzenesulfonamide, dimethyl 4-hydroxyphthalate, 1,5-bis(4-hydroxyphenylthio)-3-oxa-pentane, 1,7-bis-(4-hydroxyphenylthio)-3,5-dioxa-heptane, 1,8-bis(4-hydroxyphenylthio)-3,6-dioxa-octane, 2-(4-hydroxyphenylthio)ethyl (4-hydroxyphenylthio)acetate, novolak phenol resin, phenolic polymer and like organic acidic substances; etc. These color developers can of course be used as required in at least two of them.

Among these color developers, the use of at least one of 4,4'-cyclohexylidenebisphenol, 1,1-bis(4-hydroxyphenyl)-1-phenylethane, 1,4-bis[α-methyl-α-(4'-hydroxyphenyl)ethyl]benzene, 1,3-bis[α-methyl-α-(4'-hydroxyphenyl)ethyl]benzene and 1-[α-methyl-α-(4'-hydroxyphenyl)ethyl]-4-[α',α'-bis(4''-hydroxyphenyl)ethyl]benzene is preferable which affords a heat sensitive recording material which is less susceptible to background fog and more excellent in record density.

When using other color developer, the amount thereof is not particularly limited. It is, however, desirable to use 10 to 500 parts by weight of other color developer per 100 parts by weight of the zinc salt of terephthalaldehydic acid or the composite zinc salt of terephthalaldehydic acid and other aromatic carboxylic acid.

In the present heat sensitive recording material, a sensitizer may also be added to the recording layer depending on the purpose. Examples of useful sensitizers are stearic acid amide, stearic acid methylenebisamide, oleic acid amide, palmitic acid amide, coconut fatty acid amide or like fatty acid amides, 2-(2'-hydroxy-5'-methylphenyl)benzotriazole or like benzotriazole compound, 2-hydroxy-4-benzyloxybenzophenone or like benzophenone compounds, 1,2-di(3-methylphenoxy)ethane, 1,2-diphenoxyethane, 1-(4-methoxyphenoxy)-2-(2-methylphenoxy)ethane, 1-phenoxy-2-(4-methylphenoxy)ethane, parabenzylbiphenyl, naphthyl benzyl ether, benzyl 4-methylthiophenyl ether, phenyl 1-hydroxy-2-naphthoate, dibenzyl oxalate, di-p-methylbenzyl oxalate, di-p-chlorobenzyl oxalate, dimethyl terephthalate, dibutyl terephthalate, dibenzyl terephthalate, dibutyl isophthalate and various known heat-fusible materials.

Among the above, preferably used are 1,2-di(3-methylphenoxy)ethane, 1,2-diphenoxyethane, 1-(4-methoxyphenoxy)-2-(2-methylphenoxy)ethane and 1-phenoxy-2-(4-methylphenoxy)ethane. The amount of the sensitizer is not particularly limited and is preferably up to 4 parts by weight per one part by weight of the color developer.

In the present invention, it is further possible to use a hindered phenol compound in order to obtain a heat sensitive recording material which affords recorded images having enhanced resistance to heat and moisture. As the hindered phenol compounds are used those having a branched alkyl group or cycloalkyl group in at least one ortho position of the phenolic hydroxyl group. Examples thereof are 2,5-di-tert-butylhydroquinone, 2,5-di-tert-octylhydroquinone, 2,2'-methylenebis(4-methyl-6-tert-butylphenol), 4,4'-butylidenebis(6-tert-butyl-3-methylphenol), 2,2'-methylenebis(4-ethyl-6-tert-butylphenol), 2,4-di-tert-butyl-3-methylphenol, 4,4'-thiobis(6-tert-butyl-3-methylphenol), 1,1,3-tris(5-tert-butyl-4-hydroxy-2-methylphenyl)butane, 1,1,3-tris(5-cyclohexyl-4-hydroxy-2-methylphenyl)butane, bis(3,5-dimethyl-4-hydroxyphenyl)sulfone and 1,3,5-tris(4-tert-butyl-3-hydroxy-2,6-dimethylbenzyl-)isocyanuric acid. The amount of the hindered phenol compound is not particularly limited. It is, however, desirable to use 20 to 300 parts by weight of the hindered phenol compound per 100 parts by weight of the zinc salt of terephthalaldehydic acid or the composite zinc salt of terephthalaldehydic acid and other aromatic carboxylic acid.

For preparing a coating composition comprising the foregoing components, the basic dye, the specific color developer, etc. are dispersed, together or individually, into water serving as a dispersing medium, using stirring and pulverizing means such as a ball mill, attritor or vertical or horizontal sand mill.

In the present invention, a binder can be conjointly used in an amount of 10 to 40% by weight, preferably 15 to 30% by weight based on the total solids of the composition. Examples of useful binders are starches, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic acid copolymer salt, styrene-butadiene copolymer emulsion, etc.

Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, alginate, fatty acid metal salts, etc., ultraviolet absorbers such as benzophenone compounds, triazole compounds, etc., defoaming agents, fluorescent dyes, coloring dyes, etc.

Further, to the composition may be added zinc stearate, calcium stearate, polyethylene wax, carnauba wax, paraffin wax, ester wax or like lubricants; kaolin, clay, talc, calcium carbonate, calcined clay, titanium dioxide, kieselguhr, finely divided anhydrous silica, activated clay or like inorganic pigment.

In the present invention, the method of forming the heat sensitive recording layer is not particularly limited and the layer can be formed according to the conventional well-known technique. For example, the coating composition is applied to a substrate by an air knife coating, variable-bar blade coating, pure blade coating, short dwell coating, curtain coating or like suitable means and dried. The amount of coating composition to be applied, which is not limited particularly, is usually 2 to 12 g/m$^2$, preferably 3 to 10 g/m$^2$, based on dry weight. As the substrate is used paper, synthetic fiber paper, synthetic resin film or the like.

With the present invention, it is also possible to further improve the preservability of record images by forming a resin layer over the front surface and/or rear surface of the heat sensitive recording material. It is further possible to employ various techniques known in preparing heat sensitive recording materials, for example, to provide an undercoat layer on the substrate to assure images of an improved quality or to give an improved sensitivity, or to coat the recording material with an adhesive over the rear surface to prepare adhesive labels. Furthermore, the recording layer formed can be treated with a supercalender so that images can be formed with an improved quality or higher density.

The present invention will be described in greater detail with reference to the following examples, whereas the invention is not limited to these examples. The parts and percentages in the examples are all by weight unless otherwise specified.

EXAMPLE 1

| (1) Preparation of Composition A | |
|---|---|
| 3-(N-Cyclohexyl-N-methylamino)-6-methyl-7-phenylaminofluoran | 35 parts |
| 5% Aqueous solution of methyl cellulose | 5 parts |
| Water | 60 parts |

The above components were pulverized to a mean particle size of 2 μm by a sand mill.

| (2) Preparation oi Composition B | |
|---|---|
| Terephthalaldehydic acid | 25 parts |
| Zinc oxide | 10 parts |
| 5% Aqueous solution of methyl cellulose | 5 parts |
| Water | 60 parts |

The above components were pulverized to a mean particle size of 2 μm by a sand mill.

(3) Preparation of Composition C

The zinc salt of terephthalaldehydic acid obtained by the reaction of sodium salt of terephthalaldehydic acid and zinc sulfate was pulverized along with the following components to a mean particle size of 2 μm by a sand mill.

| | |
|---|---|
| Zinc salt of terephthalaldehydic acid | 35 parts |
| 5% Aqueous solution of methyl cellulose | 5 parts |
| Water | 60 parts |

(4) Formation of heat sensitive recording layer

A coating composition for forming a recording layer was prepared from the following components, applied to paper weighing 50 g/m$^2$ in an amount of 5 g/m$^2$ by dry weight and dried. The layer formed was made smooth-surfaced by a supercalender to obtain a heat sensitive recording material.

| | |
|---|---|
| Composition A | 100 parts |
| Composition B | 100 parts |
| 10% Aqueous solution of polyvinyl alcohol (brand name: PVA 110, product of Kuraray Co., Ltd.) | 100 parts |
| Precipitated calcium carbonate | 10 parts |
| 30% Aqueous dispersion of zinc stearate | 33 parts |
| Water | 57 parts |

EXAMPLE 2

A heat sensitive recording material was prepared in the same manner as in Example 1 except that Composition C was used in place of Composition B.

EXAMPLE 3

A heat sensitive recording material was prepared in the same manner as in Example 1 except that 3-di(n-butyl)amino-6-methyl-7-phenylaminofluoran was used in place of 3-(N-cyclohexyl-N-methylamino)-6-methyl-7-phenylaminofluoran in the preparation of Composition A.

EXAMPLE 4

A heat sensitive recording material was prepared in the same manner as in Example 1 except that 3-di(n-butyl)amino-7-(o-chlorophenylamino)fluoran was used in place of 3-(N-cyclohexyl-N-methylamino)-6-methyl-7-phenylaminofluoran in the preparation of Composition A.

EXAMPLE 5

A heat sensitive recording material was prepared in the same manner as in Example 3 with the exception of additionally using, in the formation of the recording layer, 100 parts of a sensitizer dispersion which was obtained by pulverizing the following components to a mean particle size of 1 μm by a sand mill.

| | |
|---|---|
| 1,2-Di(3-methylphenoxy)ethane | 35 parts |
| 5% Aqueous solution oi methyl cellulose | 5 parts |
| Water | 60 parts |

EXAMPLE 6

A heat sensitive recording material was prepared by applying a coating composition for the overcoat layer given below to the heat sensitive recording layer obtained in the same manner as in Example 5 in an amount of 5 g/m$^2$ by dry weight, drying the coating and treating the overcoat layer formed by a supercalender.

| | |
|---|---|
| Kaolin | 15 parts |
| 10% Aqueous solution of polyvinyl alcohol (brand name: PVA 117, product of Kuraray Co., Ltd.) | 150 parts |
| 30% Aqueous dispersion of zinc stearate | 3 parts |

EXAMPLE 7

A heat sensitive recording material was prepared in the same manner as in Example 3 with the exception of, in the formation of the recording layer, pulverizing the following components to a mean particle size of 2 μm with a sand mill and using 50 parts of the resulting composition as a color developer dispersion in combination with the zinc salt of terephthalaldehydic acid.

| | |
|---|---|
| 4,4'-Cyclohexylidenebisphenol | 17.5 parts |
| 5% Aqueous solution of methyl cellulose | 2.5 parts |
| Water | 30 parts |

EXAMPLE 8

A heat sensitive recording material was prepared in the same manner as in Example 3 with the exception of, in the formation of the recording layer, pulverizing the following components to a mean particle size of 2 μm with a sand mill and using 50 parts of the resulting composition as a color developer dispersion in combination with the zinc salt of terephthalaldehydic acid.

| | |
|---|---|
| 1,4-Bis[α-methyl-α-(4'-hydroxyphenyl)ethyl]-benzene | 17.5 parts |
| 5% Aqueous solution of methyl cellulose | 2.5 parts |
| Water | 30 parts |

EXAMPLE 9

A heat sensitive recording material was prepared in the same manner as in Example 3 with the exception of, in the formation of the recording layer, pulverizing the following components to a mean particle size of 2 μm with a sand mill and using 50 parts of the resulting composition as a color developer dispersion in combination with the zinc salt of terephthalaldehydic acid.

| | |
|---|---|
| 1,3-Bis[α-methyl-α-(4'-hydroxyphenyl)ethyl]-benzene | 17.5 parts |
| 5% Aqueous solution of methyl cellulose | 2.5 parts |

-continued

| | |
|---|---|
| Water | 30 parts |

EXAMPLE 10

A heat sensitive recording material was prepared in the same manner as in Example 3 with the exception of, in the formation of the recording layer, pulverizing the following components to a mean particle size of 2 μm with a sand mill and using 50 parts of the resulting composition as a color developer dispersion in combination with the zinc salt of terephthalaldehydic acid.

| | |
|---|---|
| 1-[α-Methyl-α-(4'-hydroxyphenyl)ethyl]-4-[α',α'-bis[4''-hydroxyphenyl)ethyl]benzene | 17.5 parts |
| 5% Aqueous solution of methyl cellulose | 2.5 parts |
| Water | 30 parts |

EXAMPLE 11

A heat sensitive recording material was prepared in the same manner as in Example 6 with the exception of applying the same coating composition for the overcoat layer as in Example 6 to the heat sensitive recording layer obtained in the same manner as in Example 7 in an amount of 5 g/m$^2$ by dry weight and drying the coating.

EXAMPLE 12

A heat sensitive recording material was prepared in the same manner as in Example 3 with the exception of additionally using, in the formation of the recording layer, 20 parts of a hindered phenol compound dispersion which was obtained by pulverizing the following components to a mean particle size of 2 μm by a sand mill.

| | |
|---|---|
| 1,1,3-Tris(5-cyclohexyl-4-hydroxy-2-methylphenyl)butane | 7 parts |
| 5% Aqueous solution of methyl cellulose | 1 part |
| Water | 12 parts |

EXAMPLE 13

A heat sensitive recording material was prepared in the same manner as in Example 3 with the exception of additionally using, in the formation of the recording layer, 20 parts of a hindered phenol compound dispersion which was obtained by pulverizing the following components to a mean particle size of 2 μm by a sand mill.

| | |
|---|---|
| 4,4'-Butylidenebis(6-tert-butyl-3-methylphenol) | 7 parts |
| 5% Aqueous solution of methyl cellulose | 1 part |
| Water | 12 parts |

EXAMPLE 14

A heat sensitive recording material was prepared in the same manner as in Example 3 with the exception of additionally using, in the formation of the recording layer, 20 parts of a hindered phenol compound dispersion which was obtained by pulverizing the following components to a mean particle size of 2 μm by a sand mill.

| | |
|---|---|
| 4,4'-Thiobis(6-tert-butyl-3-methylphenol) | 7 parts |
| 5% Aqueous solution of methyl cellulose | 1 part |
| Water | 12 parts |

COMPARATIVE EXAMPLE 1

A heat sensitive recording material was prepared in the same manner as in Example 1 except that, in the preparation of Composition B, 35 parts of bisphenol A was used in place of 25 parts of terephthalaldehydic acid and 10 parts of zinc oxide.

COMPARATIVE EXAMPLE 2

A heat sensitive recording material was prepared in the same manner as in Example 1 except that, in the preparation of Composition B, 35 parts of 4-hydroxyphenyl-4'-isopropoxyphenylsulfone was used in place of 25 parts of terephthalaldehydic acid and 10 parts of zinc oxide.

COMPARATIVE EXAMPLE 3

A heat sensitive recording material was prepared in the same manner as in Example 6 with the exception of applying the same coating composition for the overcoat layer as in Example 6 to the heat sensitive recording layer obtained in the same manner as in Comparative Example 2 in an amount of 5 g/m$^2$ by dry weight and drying the coating.

The seventeen kinds of heat sensitive recording materials thus obtained were tested for the evaluation of properties by the following methods. Table 1 shows the results.

Color Density

Images were recorded on the recording material by a thermal printer (product of Texas Instruments Inc., Model PC-100R) and checked for color density by a Macbeth densitometer (product of Macbeth Corp., Model RD-100R).

Resistance to Plasticizer

A vinylidene chloride wrapping film (product of Mitsui Toatsu Chemicals Inc.) was wound around a polypropylene pipe (40 mm in diameter) in three layers, the recording material having color images recorded thereon by printing was placed over the winding with the color bearing surface out, the vinylidene chloride wrapping film was further wound around the pipe over the recording material in three layers, and the assembly was allowed to stand at 40° C. for 24 hours. The color density of the recorded images was thereafter measured by the Macbeth densitometer again to evaluate the plasticizer resistance of the recording material.

Oil Resistance

Cotton seed oil was applied dropwise to the recording material bearing color images formed thereon by printing, and the recording material was then allowed to stand at room temperature for 24 hours and thereafter checked for the state of the images with the unaided eye for evaluation.

Solvent Resistance

Ethanol was applied dropwise on the recording material bearing color images formed thereon by printing and checked for the state of the images and the background with the unaided eye for evaluation after dried.

Heat Resistance

The recording material after printing was treated in a drier at 60° C. for 24 hours and thereafter checked for the state of the images and the background with the unaided eye for evaluation.

Moisture Resistance

The recording material after printing was subjected to the condition of 50° C. and 75% RH for 24 hours and thereafter checked for the state of the images and the background with the unaided eye for evaluation.

Criteria of Evaluation

The oil resistance, solvent resistance, heat resistance and moisture resistance were evaluated according to the following criteria.

◎: The record images do not fade (or the background do not fog) at all

○: The record images slightly fade (or the background slightly foggs) but practically no problem Δ: The record images fade (or the background foggs) and problem depending on the grade ×: The record images markedly fade (or the background markedly foggs) and practically unsuitable

TABLE 1

| | Color Density | Resist. to Plasticizer | Oil Resist. | Solvent Resist. | Heat Resist. | Moisture Resist. |
|---|---|---|---|---|---|---|
| Ex. 1 | 1.15 | 1.10 | ○ | ○ | ○ | ○ |
| Ex. 2 | 1.16 | 1.11 | ○ | ○ | ○ | ○ |
| Ex. 3 | 1.19 | 1.13 | ○ | ○ | ○ | ○ |
| Ex. 4 | 1.17 | 1.10 | ○ | ○ | ○ | ○ |
| Ex. 5 | 1.34 | 1.30 | ○ | ○ | ○ | ○ |
| Ex. 6 | 1.30 | 1.29 | ◎ | ◎ | ○ | ○ |
| Ex. 7 | 1.35 | 1.30 | ○ | ○ | ○ | ○ |
| Ex. 8 | 1.36 | 1.32 | ○ | Δ | ○ | ○ |
| Ex. 9 | 1.35 | 1.31 | ○ | Δ | ○ | ○ |
| Ex. 10 | 1.30 | 1.27 | ○ | Δ | ○ | ○ |
| Ex. 11 | 1.32 | 1.30 | ◎ | ◎ | ○ | ○ |
| Ex. 12 | 1.23 | 1.20 | ○ | ○ | ◎ | ◎ |
| Ex. 13 | 1.22 | 1.19 | ○ | ○ | ◎ | ◎ |
| Ex. 14 | 1.24 | 1.18 | ○ | ○ | ◎ | ◎ |
| Com. Ex. 1 | 1.32 | 0.09 | x | x | ○ | ○ |
| Com. Ex. 2 | 1.30 | 0.08 | x | x | ○ | ○ |
| Com. Ex. 3 | 1.28 | 0.43 | Δ | Δ | ○ | ○ |

As apparent from Table 1, the present heat sensitive recording material is excellent in the preservability of the record images and less susceptible to background fog.

EXAMPLE 15

| (1) Preparation of Composition A | |
|---|---|
| 3-(N-Cyclohexyl-N-methylamino)-6-methyl-7-phenylaminofluoran | 35 parts |
| 5% Aqueous solution of methyl cellulose | 5 parts |
| Water | 60 parts |

These components were pulverized by a sand mill to a mean particle size of 2 μm.

(2) Preparation of Composition B

A 15 g of quantity of terephthalaldehydic acid, 8.3 g of isophthalic acid and 4 g of sodium hydroxide were added to 200 ml of water, and the mixture was heated to 70° C. with stirring to prepare a solution. A solution of 28.8 g of zinc sulfate heptahydrate in 500 ml of water was then added dropwise to the solution over a period of 20 minutes. After the completion of addition, the mixture was stirred for 1 hour and thereafter cooled to 50° C., the precipitate formed was dissolved with 300 ml of ethyl acetate added to the mixture, and the ethyl acetate phase was subsequently separated off. The ethyl acetate solution separated off was distilled in a vacuum to remove the ethyl acetate to obtain a zinc salt mixture primarily comprising a composite zinc salt of terephthalaldehydic acid and isophthalic acid. The product was pulverized along with the components given below to a mean particle size of 2 μm by a sand mill.

| | |
|---|---|
| Zinc salt mixture primarily comprising composite zinc salt of terephthalaldehydic acid and isophthalic acid | 35 parts |
| 10% Aqueous solution of dispersant (sulfone group modified polyvinyl alcohol, brand name: Gohseran L-3266, product of Nippon Synthetic Chemical Industry Co., Ltd.) | 45 parts |
| Water | 20 parts |

(3) Formation of heat sensitive recording layer

A coating composition for forming a heat sensitive recording layer was prepared from the following components, applied to paper weighing 50 g/m$^2$ in an amount of 5 g/m$^2$ by dry weight and dried. The layer was made smooth-surfaced by a supercalender to obtain a heat sensitive recording material.

| | |
|---|---|
| Composition A | 100 parts |
| Composition B | 100 parts |
| 10% Aqueous solution of polyvinyl alcohol (brand name: PVA 110, product of Kuraray Co., Ltd.) | 100 parts |
| Finely divided silica | 10 parts |
| 30% Aqueous dispersion of zinc stearate | 33 parts |
| Water | 57 parts |

EXAMPLE 16

A heat sensitive recording material was prepared in the same manner as in Example 15 except that 13.6 g of p-toluic acid was used in place of 8.3 g of isophthalic acid for preparing a composite zinc salt for Composition B.

EXAMPLE 17

A heat sensitive recording material was prepared in the same manner as in Example 15 except that 26.1 g of 2-(4'-chlorobenzoyl)benzoic acid was used in place of 8.3 g of isophthalic acid for preparing a composite zinc salt for Composition B.

EXAMPLE 18

(1) Preparation of Composition C

The following components were pulverized by a sand mill to a mean particle size of 2 μm to obtain a dispersion of a zinc salt mixture primarily comprising a composite zinc salt of terephthalaldhydic acid and isophthalic acid.

| | |
|---|---|
| Terephthalaldehydic acid | 15 parts |
| Isophthalic acid | 8.3 parts |
| Zinc oxide | 8.1 parts |
| 10% Aqueous solution of dispersant (brand name: Gohseran L-3266, product of Nippon Synthetic Chemical Industry Co., Ltd.) | 45 parts |
| Water | 25 parts |

(2) Formation of heat sensitive recording layer

A coating composition for forming a heat sensitive recording layer was prepared from the following components, applied to paper weighing 50 g/m$^2$ in an amount of 5 g/m$^2$ by dry weight and dried. The layer was made smooth-surfaced by a supercalender to obtain a heat sensitive recording material.

| | |
|---|---|
| Composition A | 100 parts |
| Composition C | 100 parts |
| 10% Aqueous solution of polyvinyl alcohol (brand name: PVA 110, product of Kuraray Co., Ltd.) | 100 parts |
| Finely divided silica | 10 parts |
| 30% Aqueous dispersion of zinc stearate | 33 parts |
| Water | 57 parts |

EXAMPLE 19

A heat sensitive recording material was prepared in the same manner as in Example 18 except that, in the preparation of Composition C, 13.6 parts of p-toluic acid was used in place of 8.3 parts of isophthalic acid.

EXAMPLE 20

A heat sensitive recording material was prepared in the same manner as in Example 18 except that, in the preparation of Composition C, 26.1 parts of 2-(4'-chlorobenzoyl)benzoic acid was used in place of 8.3 parts of isophthalic acid.

EXAMPLE 21

| (1) Preparation of Composition D | |
|---|---|
| 3-Di(n-butyl)amino-6-methyl-7-phenylaminofluoran | 35 parts |
| 5% Aqueous solution o! methyl cellulose | 5 parts |
| Water | 60 parts |

These components were pulverized by a sand mill to a mean particle size of 2 μm.

| (2) Preparation of Composition E | |
|---|---|
| 1,2-Bis(3-methylphenoxy)ethane | 35 parts |
| 5% Aqueous solution of methyl cellulose | 5 parts |
| Water | 60 parts |

These components were pulverized by a sand mill to a mean particle size of 2 μm.

(3) Formation of heat sensitive recording layer

A coating composition for forming a heat sensitive recording layer was prepared from the following components, applied to paper weighing 50 g/m$^2$ in an amount of 5 g/m$^2$ by dry weight and dried. The layer was made smooth-surfaced by a supercalender to obtain a heat sensitive recording material.

| | |
|---|---|
| Composition B | 100 parts |
| Composition D | 100 parts |
| Composition E | 100 parts |
| 10% Aqueous solution of polyvinyl alcohol (brand name: PVA 110, product of Kuraray Co., Ltd.) | 100 parts |
| Finely divided silica | 10 parts |
| 30% Aqueous dispersion of zinc stearate | 33 parts |
| Water | 57 parts |

EXAMPLE 22

A heat sensitive recording material was prepared in the same manner as in Example 21 except that, in the formation of the recording layer, 101.4 parts of Composition C was used in place of 100 parts of Composition B.

EXAMPLE 23

| (1) Preparation of Composition F | |
|---|---|
| 1-[α-methyl-α-(4'-hydroxyphenyl)ethyl]-4-[α',α'-bis(4''-hydroxyphenyl)ethyl]benzene | 17.5 parts |
| 5% Aqueous solution of methyl cellulose | 2.5 parts |
| Water | 30 parts |

These components were pulverized by a sand mill to a mean particle size of 2 μm.

(2) Formation of heat sensitive recording layer

A coating composition for forming a heat sensitive recording layer was prepared from the following components, applied to paper weighing 50 g/m$^2$ in an amount of 5 g/m$^2$ by dry weight and dried. The layer was made smooth-surfaced by a supercalender to obtain a heat sensitive recording material.

| | |
|---|---|
| Composition C | 101.4 parts |
| Composition D | 100 parts |
| Composition F | 50 parts |
| 10% Aqueous solution of polyvinyl alcohol (brand name: PVA 110, product of Kuraray Co., Ltd.) | 100 parts |
| Finely divided silica | 10 parts |
| 30% Aqueous dispersion of zinc stearate | 33 parts |
| Water | 57 parts |

EXAMPLE 24

A heat sensitive recording material was prepared in the same manner as in Example 23 except that, in the preparation of Composition F, 1,4-bis[α-methyl-α-(4'-hydroxyphenyl)ethyl]benzene was used in place of 1-[α-methyl-α-(4'-hydroxyphenyl)ethyl]-4-[α',α'-bis(4''-hydroxyphenyl)ethyl]benzene.

EXAMPLE 25

A heat sensitive recording material was prepared in the same manner as in Example 23 except that, in the preparation of Composition F, 1,3-bis[α-methyl-α-(4'-hydroxyphenyl)ethyl]benzene was used in place of 1-[α-methyl-α-(4'-hydroxyphenyl)ethyl]-4-[α',α'-bis(4''-hydroxyphenyl)ethyl]benzene.

EXAMPLE 26

A heat sensitive recording material was prepared in the same manner as in Example 23 except that, in the preparation of Composition F, 1,1-bis(4-hydroxyphenyl)-1-phenylethane was used in place of 1-[α-methyl-α-(4'-hydroxyphenyl)ethyl]-4-[α',α'-bis(4''-hydroxyphenyl)-ethyl]benzene.

EXAMPLE 27

| (1) Preparation of Composition G | |
|---|---|
| 1,1,3-Tris(5-cyclohexyl-4-hydroxy-2-methylphenyl)butane | 7 parts |
| 5% Aqueous solution of methyl cellulose | 1 part |
| Water | 12 parts |

These components were pulverized by a sand mill to a mean particle size of 2 μm.

(2) Formation of heat sensitive recording layer

A coating composition for forming a heat sensitive recording layer was prepared from the following components, applied to paper weighing 50 g/m$^2$ in an amount of 5 g/m$^2$ by dry weight and dried. The layer was made smooth-surfaced by a supercalender to obtain a heat sensitive recording material.

| | |
|---|---|
| Composition C | 101.4 parts |
| Composition D | 100 parts |
| Composition G | 20 parts |
| 10% Aqueous solution of polyvinyl alcohol (brand name: PVA 110, product of Kuraray Co., Ltd.) | 100 parts |
| Finely divided silica | 10 parts |
| 30% Aqueous dispersion of zinc stearate | 33 parts |
| Water | 57 parts |

EXAMPLE 28

A heat sensitive recording material was prepared in the same manner as in Example 27 except that, in the preparation of Composition G, 4,4'-butylidenebis(6-tert-butyl-3-methylphenol) was used in place of 1,1,3-tris(5-cyclohexyl-4-hydroxy-2-methylphenyl)butane.

EXAMPLE 29

A heat sensitive recording material was prepared in the same manner as in Example 27 except that, in the preparation of Composition G, 4,4'-thiobis(6-tert-butyl-3-methylphenol) was used in place of 1,1,3-tris(5-cyclohexyl-4-hydroxy-2-methylphenyl)butane.

COMPARATIVE EXAMPLE 4

| (1) Preparation of Composition H | |
|---|---|
| Bisphenol A | 30 parts |
| 5% Aqueous solution of methyl cellulose | 5 parts |
| Water | 65 parts |

The above components were pulverized to a mean particle size of 2 μm by a sand mill.

(2) Formation of heat sensitive recording layer

A heat sensitive recording material was prepared in the same manner as in Example 15 except that 100 parts of Composition H above was used in place of 100 parts of Composition B used for forming the heat sensitive recording layer in Example 15.

The sixteen kinds of heat sensitive recording materials thus obtained were tested for the evaluation of properties by the following methods. Table 2 shows the results.

Color Density

Images were recorded on the recording material by a thermal printer (Ohkura Simulater, 0.4 mJ/dot in printing energy) and checked for color density by a Macbeth densitometer (product of Macbeth Corp., Model RD-100R). [Resistance to Plasticizer]

A vinylidene chloride wrapping film (product of Mitsui Toatsu Chemicals Inc.) was wound around a polypropylene pipe (40 mm in diameter) in three layers, the recording material having color images recorded thereon by printing was placed over the winding with the color bearing surface out, the vinylidene chloride wrapping film was further wound around the pipe over the recording material in three layers, and the assembly was allowed to stand at room temperature for 3 days. The color density of the recorded images was thereafter measured by the Macbeth densitometer again to evaluate the plasticizer resistance of the recording material.

Oil Resistance

Cotton seed oil was applied dropwise to the recording material bearing color images formed thereon by printing, and the recording material was then allowed to stand for 24 hours and thereafter checked for the state of the images with the unaided eye for evaluation.

Solvent Resistance

Characters were written with a solvent-type-ink felt pen (yellow) on the recording material bearing color images formed thereon by printing and thereafter checked for the state of the images and the background with the unaided eye for evaluation.

Heat Resistance

The recording material after printing was treated in a dry condition at 60° C. for 24 hours and thereafter checked for the state of the images and the background with the unaided eye for evaluation.

Moisture Resistance

The recording material after printing was subjected to the condition of 50° C. and 75% RH for 24 hours and thereafter checked for the state of the images and the background with the unaided eye for evaluation.

Criteria of Evaluation

The oil resistance, solvent resistance, heat resistance and moisture resistance were evaluated according to the following criteria.

◎ : The record images do not fade (or the background do not fog) at all

○ : The record images slightly fade (or the background slightly foggs) but practically no problem Δ: The record images fade (or the background foggs) and problem depending on the grade ×: The record images markedly fade (or the background markedly foggs) and practically unsuitable

TABLE 2

| | Color Density | Resist. to Plasticizer | Oil Resist. | Solvent Resist. | Heat Resist. | Moisture Resist. |
|---|---|---|---|---|---|---|
| Ex. 15 | 1.30 | 1.10 | ◎ | ○ | ○ | ○ |
| Ex. 16 | 1.32 | 1.15 | ◎ | ○ | ○ | ○ |
| Ex. 17 | 1.29 | 1.13 | ◎ | ○ | ○ | ○ |
| Ex. 18 | 1.15 | 0.97 | ○ | ○ | ○ | ○ |
| Ex. 19 | 1.18 | 0.99 | ○ | ○ | ○ | ○ |
| Ex. 20 | 1.17 | 0.95 | ○ | ○ | ○ | ○ |
| Ex. 21 | 1.33 | 1.21 | ◎ | ○ | ○ | ○ |
| Ex. 22 | 1.29 | 1.20 | ○ | ○ | ○ | ○ |
| Ex. 23 | 1.32 | 1.25 | ○ | ○ | ○ | ○ |
| Ex. 24 | 1.33 | 1.27 | ○ | ○ | ○ | ○ |
| Ex. 25 | 1.30 | 1.24 | ○ | ○ | ○ | ○ |
| Ex. 26 | 1.34 | 1.28 | ○ | ○ | ○ | ○ |
| Ex. 27 | 1.24 | 1.17 | ○ | ○ | ◎ | ◎ |
| Ex. 28 | 1.27 | 1.21 | ○ | ○ | ◎ | ◎ |
| Ex. 29 | 1.25 | 1.19 | ○ | ○ | ◎ | ◎ |
| Com. Ex. 4 | 1.35 | 0.09 | x | x | ○ | ○ |

As apparent from Table 2, the present heat sensitive recording material is extremely excellent in the preservability of the record images and the background portion, and sufficient in the recording sensitivity.

We claim:

1. A heat sensitive recording material having a recording layer formed on a substrate and containing a colorless or light-colored basic dye and a color developer, the heat sensitive recording material being characterized in that the color developer comprises a zinc salt of terephthaladehydic acid.

2. A heat sensitive recording material as defined in claim 1 wherein the zinc salt of terephthalaldehydic acid is a composite zinc salt of terephthalaldehydic acid and other aromatic carboxylic acid.

3. A heat sensitive recording material as defined in claim 2 wherein other aromatic carboxylic acid is at least one compound selected from the group consisting of a benzoic acid derivative represented by the formula

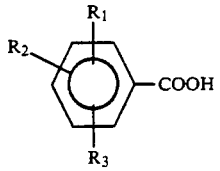

wherein $R_1$, $R_2$ and $R_3$ are each selected from hydrogen atom, halogen atom, nitro, hydroxy, cyano, trifluoromethyl, $C_{1-4}$ alkyl, cyclohexyl, $C_{1-4}$ alkoxyl, ethoxymethyl, acetyl, phenyl, phenoxy, chlorophenoxy, phenoxyethoxy, benzyl, methylbenzyl and cumyl;

a naphthoic acid derivative represented by the formula

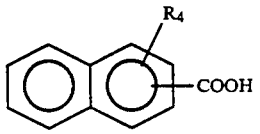

wherein $R_4$ is hydrogen atom or hydroxy;

a phthalic acid derivative represented by the formula

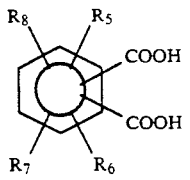

wherein $R_5$–$R_8$ are each hydrogen atom, halogen atom or nitro;

a phthalic acid monoester derivative represented by the formula

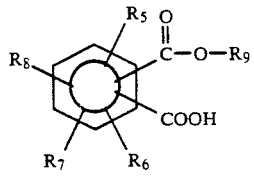

wherein $R_5$–$R_8$ are each hydrogen atom, halogen atom or nitro; $R_9$ is $C_{1-20}$ alkyl, $C_{1-20}$ alkyl substituted with hydroxy or $C_{1-4}$ alkoxy, cyclohexyl, cyclohexyl substituted with $C_{1-4}$ alkyl, phenyl, phenyl substituted with halogen atom, $C_{1-4}$ alkyl or $C_{1-4}$ alkoxyl, naphthyl, benzyl, benzyl substituted with halogen atom, $C_{1-4}$ alkyl or $C_{1-4}$ alkoxyl;

a phthalamic acid derivative represented by the formula

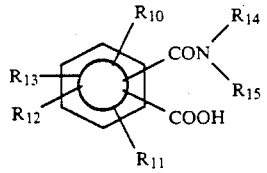

wherein $R_{10}$–$R_{13}$ are each hydrogen or halogen and $R_{14}$ and $R_{15}$ are each selected from the group consisting of hydrogen, $C_{1-4}$ alkyl, cyclohexyl, phenyl, naphthyl, benzyl, methylbenzyl, and chlorobenzyl, or $R_{14}$ and $R_{15}$ may form a piperidine ring together with an adjacent nitrogen atom;

an o-benzoylbenzoic acid derivative represented by the formula

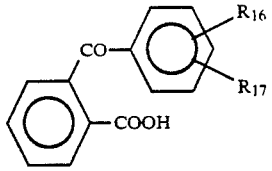

wherein $R_{16}$ and $R_{17}$ are each hydrogen atom, halogen atom, hydroxy, $C_{1-8}$ alkyl, cyclohexyl or phenyl;

and a salicylic acid derivative represented by the formula

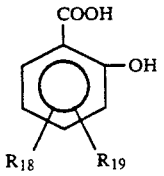

wherein $R_{18}$ and $R_{19}$ are each selected from hydrogen atom, halogen atom, $C_{1-20}$ alkyl, $C_{1-20}$ alkylsulfonyl, $C_{1-20}$ alkysulfo, phenyl, benzyl, α-methylbenzyl, cumyl, diphenylmethyl, and triphenylmethyl.

4. A heat sensitive recording material as defined in claim 3 wherein other aromatic carboxylic acid is at least one compound selected from the group consisting of benzoic acid derivative, phthalic acid derivative and o-benzoylbenzoic acid derivative.

5. A heat sensitive recording material as defined in claim 4 wherein the benzoic acid derivative is a compound represented by the formula

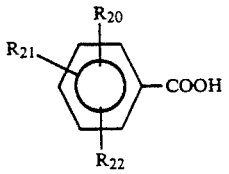

wherein $R_{20}$, $R_{21}$ and $R_{22}$ are each hydrogen atom, halogen atom, $C_{1-4}$ alkyl or $C_{1-4}$ alkoxyl.

6. A heat sensitive recording material as defined in claim 4 wherein the phthalic acid derivative is a compound represented by the formula

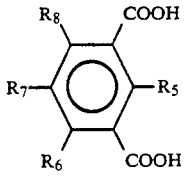

wherein $R_5$–$R_8$ are each hydrogen atom, halogen atom or nitro.

7. A heat sensitive recording material as defined in claim 4 wherein the o-benzoylbenzoic acid derivative is a compound represented by the formula

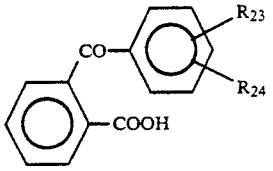

wherein $R_{23}$ and $R_{24}$ are each hydrogen atom, halogen atom or $C_{1-4}$ alkyl.

8. A heat sensitive recording material as defined in claim 4 wherein other aromatic carboxylic acid is at least one compound selected from the group consisting of p-toluic acid, isophthalic acid and 2-(4'-chlorobenzoyl)benzoic acid.

9. A heat sensitive recording material as defined in claim 2 wherein the composite zinc salt of terephthalaldehydic acid and other aromatic carboxylic acid is obtained by using 0.5 to 2 equivalent weights of other aromatic carboxylic acid per one equivalent weight of terephthaladehydic acid.

10. A heat sensitive recording material as defined in claim 1 wherein 0.5 to 50 parts by weight of the zinc salt of terephthalaldehydic acid is used per one part by weight of the basic dye.

11. A heat sensitive recording material as defined in claim 1 wherein the basic dye comprises 3-di(n-butyl-)amino-6-methyl-7-phenylaminofluoran.

* * * * *